United States Patent [19]

Gauvain

[11] 4,372,010

[45] Feb. 8, 1983

[54] APPARATUS FOR THE AUTOMATIC INFEED OF A TEXTILE FIBRE SHEET INTO A COILER

[75] Inventor: Roger Gauvain, Buhl, France

[73] Assignee: Societe Alsacienne de Constructions Mecaniques de Mulhouse, France

[21] Appl. No.: 188,077

[22] Filed: Sep. 17, 1980

[30] Foreign Application Priority Data

Sep. 28, 1979 [FR] France ..... 79 24188

[51] Int. Cl.[3] ..... D04H 11/00; D01H 5/72

[52] U.S. Cl. ..... 19/159 R; 19/288

[58] Field of Search ..... 19/159 R, 288, 262; 28/250, 273

[56] References Cited

U.S. PATENT DOCUMENTS 3,020,600 2/1962 West ..... 19/288 X
3,327,356 6/1967 Andreani ..... 19/159 R
3,409,944 11/1968 Kajimura et al. ..... 19/262
3,413,696 12/1968 Flowers et al. ..... 28/250
3,490,219 1/1970 Ozawa et al. ..... 28/273
4,236,278 12/1980 Hoover ..... 19/159 R

*Primary Examiner*—Louis Rimrodt
*Attorney, Agent, or Firm*—George H. Gerstman

[57] ABSTRACT

Apparatus for the automatic infeed of a fibre sheet into a coiler comprises a smooth-surfaced transverse guide 6 to be placed at the delivery side of a pair of drawing rollers 1, 2. The guide 6 has an orifice 7 for gathering into a tuft the fibre sheet 3 coming from said pair of drawing rollers, a cylindrical outlet tube 8 extending said orifice 7, pneumatic means 18 for drawing the tuft into the outlet tube 8, and a pair of draw rolls 9 set at the downstream end of the outlet tube.

The invention may be applied to the introduction of a fibre sheet into a coiler, the fibre sheet leaving the last pair of rollers of the drafting train of a machine.

2 Claims, 3 Drawing Figures

APPARATUS FOR THE AUTOMATIC INFEED OF A TEXTILE FIBRE SHEET INTO A COILER

The present invention relates to the introduction of a fibre sheet into a coiler, for example the fibre sheet leaving the last pair of rollers of the drafting train of a machine, after having been converted into a tuft, with a view to packing same into cans.

Normally, this operation is carried out manually. The fibre sheet is grasped and is rolled between the two hands to start a roll which is introduced into a conduit whereof the end is flared funnel-like in order to facilitate the running through of the tuft; the end of the tuft is then taken up by the coiler.

This way of proceeding can be applied only with difficulty to high-speed, high draft drawing frames, because the fibre sheet which they deliver is so fine that it is almost impossible to lay hold of it without tearing it. On the other hand, this archaic manner of operation is time-consuming in the running of a high-production machine in which all other phases of the work follow one another automatically.

The object of the present invention is to provide apparatus a device enabling this work to be done automatically, and consequently, to obviate or mitigate the above-mentioned disadvantages of manual procedures.

For this purpose, according to the invention, the apparatus comprises a smooth surfaced transverse guide to be placed at the delivery side of a pair of drawing rollers and having an orifice for gathering into a tuft the fibre sheet coming from said pair of drawing rollers, a cylindrical outlet tube extending said gathering orifice, pneumatic means for drawing the tuft into the outlet tube, and a pair of draw rolls set at the downstream end of the outlet tube.

The invention will be more readily understood on reading the description which follows and on examining the accompanying drawings which illustrate, by way of example, an embodiment of the invention.

Figure 1:
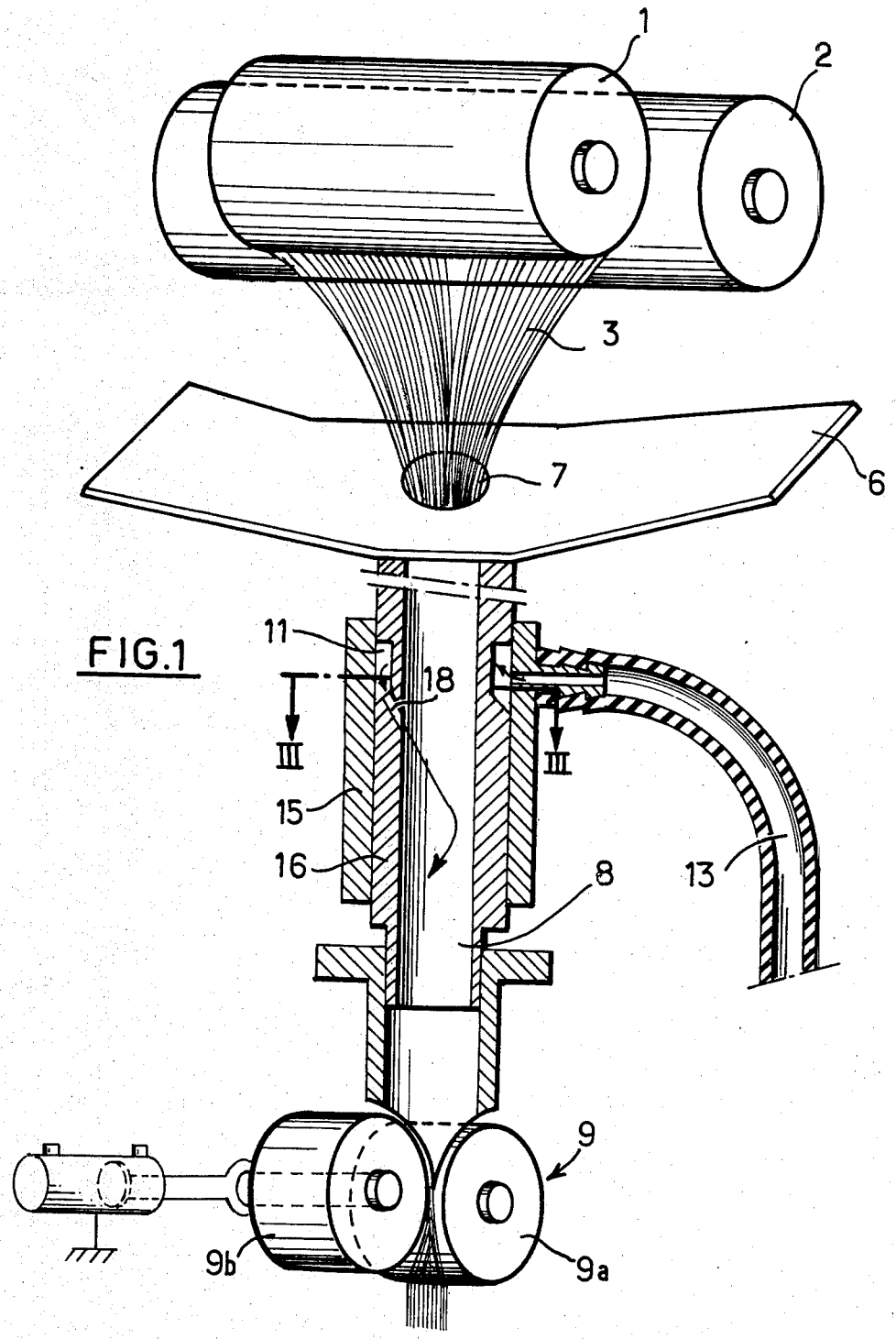
FIG. 1 is a perspective view, partly in section of an apparatus according to the invention.
Figure 2:
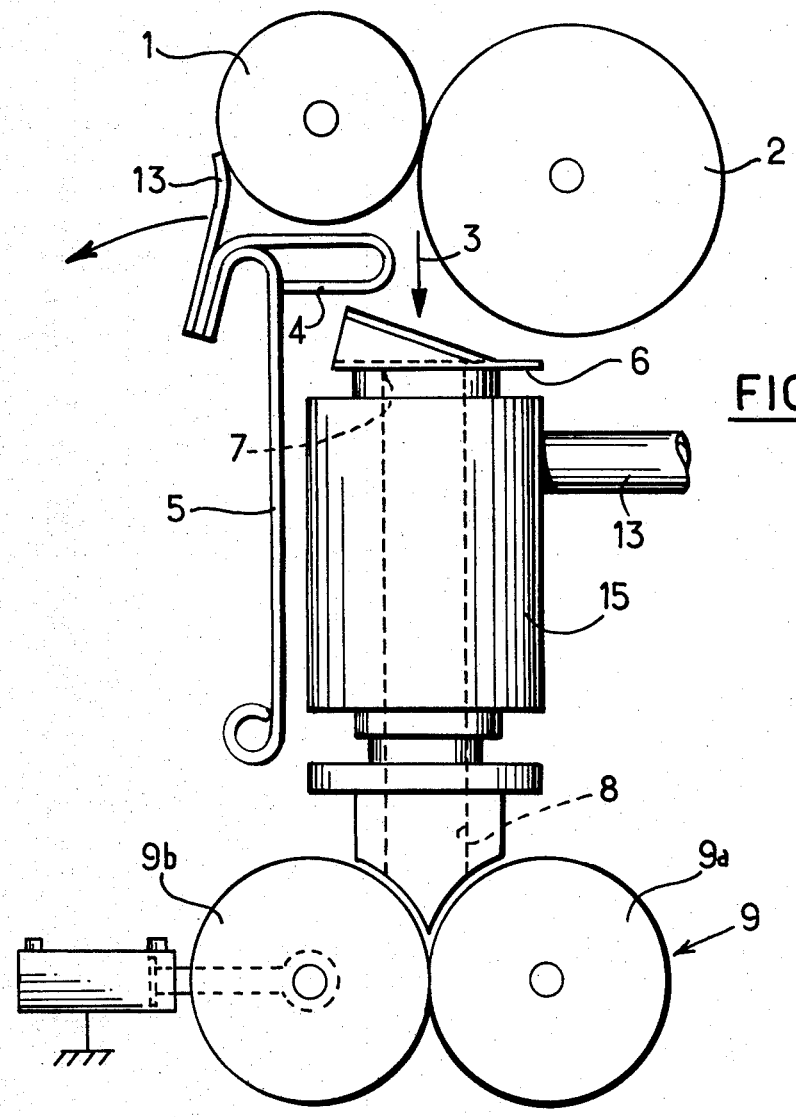
FIG. 2 is a side elevation of the apparatus of FIG. 1.
Figure 3:
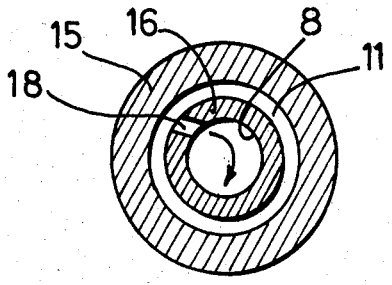
FIG. 3 is a section on the line III—III in FIG. 1.

The rollers 1 and 2 represent the last stage of the drafting train of a machine. The fibres come out from the rollers 1 and 2 in the form of a sheet 3 which, in the case of a high draft machine is extremely fine and fragile. This sheet rests on a part 4 integral with the gate 5 and on a deflector 6; it has to be drawn together into a tuft to enter through an orifice 7 into a tube 8 which guides it up to the pulling device 9 formed by a set of two rolls **9*a* and 9*b*** acting as draw rolls in order to convey the tuft to a can coiler (not illustrated) in known manner.

When the drafting machine is operating at its production speed, by virtue of the shape of the deflector 6, a cushion of air is aerodynamically established on the surface of the deflector. This cushion of air raises the fibre sheet and acts as a funnel in order to introduce it into the tube 8. The surface condition of the deflector 6 is extremely important in order that the fibre sheet may thus be separated aerodynamically therefrom. The fibres, as a matter of fact, cling to a polished surface and tear on roughnesses which are unduly pointed. A strict compromise must be worked out. It would appear that the most advantageous solution is the following one: the steel part is scoured by an appropriate sand blasting operation, then the edge is taken off the roughnesses by chemical attack, and finally the part is chromiumplated. This treatment is known as "micromatting".

Compressed air is introduced through a pipeline 13; it is distributed in an annular chamber 11 formed between two tubular members 15 and 16 and enters into the tube 8 through at least one extremely narrow passage 18. The whole functions in the manner of a venturi and vigorously draws off the fibres 3 which are drawn into the tube 8 through the orifice 7. The passage 18 opens into the tube 8 tangentially to the internal surface of the latter in order to impart to the fibres a helical motion which confers, to the tuft thus formed, a certain amount of twist adapted to increase its stability.

In order that this suction may take place, it is necessary that the downstream or lower end of the tube 8 be open. In order that this is the case, the roll **9*b* of the pulling device 9 is moved from its position by a pneumatic jack 20 which applies pressure to the support of said roll (not illustrated). The supplies of compressed air to the annular chamber 11 and to the jack 20 is effected simultaneously by means of a double-acting valve (not illustrated). When the fibre sheet coming out of the tube 8 is inserted between the two rolls 9*a* and 9*b* of the pulling device 9, the supply of compressed air is cut off, the cylinder 9*b* returns to its normal position, and the tuft is carried away towards the coiler by the rotation of the two rolls 9*a* and 9*b***.

Should the tuft break downstream of the orifice 7, the fibres accumulate in the region between the drawing rollers 1 and 2 and the deflector 6. When their volume is sufficient, they exert a thrust on the gate 5; this thrust causes the opening of the gate which stops the machine by any suitable, conventional means.

As has been stated hereinbefore, the fibre sheet 3 rests upon the part 4 situated at the upper part of the gate 5. The form and the surface condition of this part are such that the fibre sheet 3 cannot be damaged by contact therewith. Moreover, since this part is of metal and is in contact with the frame of the drawing machine by way of a series of metal pieces, it contributes effectively to the elimination of static electricity which is developed on the fibres travelling at high speed and might adversely influence the conditioning thereof by the pneumatic means.

A kind of scraper 14 is attached to the part 4 and rests against the surface of the cylinder 1, cleaning it continuously, which is necessary in order to ensure that the fibre sheet forms correctly and can be influenced by the pneumatic means.

I claim:

1. Apparatus for the automatic infeed of a textile fibre sheet into a coiler, for example at the delivery side of a drafting machine, comprising a smooth-surfaced transverse guide to be placed at the delivery side of a pair of drawing rollers and having an orifice for gathering into a tuft the fibre sheet coming from said pair of rollers, a cylindrical outlet tube extending from said gathering orifice, pneumatic means coupled to said cylindrical outlet for inducing a suction of air therein and drawing the tuft into the outlet tube, and a pair of final draw rolls set at the downstream end of the outlet tube, said final rolls being positioned in their normal working made in a closed position to close substantially said downstream end for mechanically drawing the tuft through said rolls, and one of said final rolls being temporarily movable to a separated position apart from the other roll to open said downstream end and to cause said pneumatic means to induce a suction of air through said tube to drive the leading end of the tuft through said rolls.

2. Apparatus according to claim 1 in which the supply of air to said pneumatic means is controlled by said movement one of said rolls to said separated position.

* * * * *